United States Patent [19]

Curran et al.

[11] Patent Number: 4,533,437

[45] Date of Patent: Aug. 6, 1985

[54] PAPERMAKING MACHINE

[75] Inventors: John F. Curran, West Chester; Thomas N. Kershaw, Wallingford, both of Pa.

[73] Assignee: Scott Paper Company, Philadelphia, Pa.

[21] Appl. No.: 442,059

[22] Filed: Nov. 16, 1982

[51] Int. Cl.[3] ..... D21F 3/00

[52] U.S. Cl. ..... 162/281; 162/111; 162/113; 162/359; 162/361; 162/362

[58] Field of Search ..... 162/111, 113, 117, 281, 162/206, 358, 359, 361, 362

[56] References Cited

U.S. PATENT DOCUMENTS

| | | | |
|---|---|---|---|
| 3,537,954 | 11/1970 | Justus | 162/113 |
| 3,905,863 | 9/1975 | Ayers | 162/113 |
| 4,191,609 | 3/1980 | Trokhan | 162/113 |
| 4,196,045 | 4/1980 | Ogden | 162/206 |
| 4,302,282 | 11/1981 | Young | 162/281 |

*Primary Examiner*—Peter Chin

*Attorney, Agent, or Firm*—John W. Kane; Joseph H. Yamaoka

[57] ABSTRACT

The invention relates to a papermaking machine employing a differential pressing felt for simultaneously dewatering the paper web and imprinting the paper web as the web is deposited onto the surface of a heated drying cylinder. The felt has a felt facing material greater than about 153 grams/m$^2$ and imprinting yarn strands forming knuckles adjacent to the felt facing. The yarn strands have a spacing of about 6 to about 25 0.0254 meters.

30 Claims, 10 Drawing Figures

102

PAPERMAKING MACHINE

TECHNICAL FIELD

This invention relates generally to a papermaking machine for making sanitary paper tissue and towel products. This invention is more specifically directed to a papermaking machine which employs a differential pressing felt for simultaneously dewatering the web and imprinting the web in spots as it is deposited onto the surface of a heated drying cylinder.

BACKGROUND ART

In what is generally accepted by those skilled in the papermaking art as a conventional process for manufacturing paper webs for use as sanitary tissue and towel products, the web is subjected during the dewatering process to one or more pressing operations over the entire surface of the web. In one such conventional papermaking process, the web is formed on a Fourdrinier wire and then is transferred to a pick up felt. The pick up felt and the paper web is passed through a nip formed by a pressure roll and the surface of a heated Yankee Dryer cylinder. The felt has a relatively smooth surface so that as the felt and paper web travel through the nip, pressure is applied uniformly over the entire surface of the moist paper web for the purposes of squeezing water out of the paper web into the felt, developing tensile strength in the web, smoothing the surface of the web and adhering the surface of the web to the surface of the drying cylinder. The web is then creped off of the surface of the drying cylinder.

If the conventional process for manufacturing a paper web represents one end of the spectrum, then the process described in U.S. Pat. No. 3,301,746 - Sanford, et al is representative of the other end of the spectrum. In the process described by Sanford, et al, a paper web is laid down on a forming wire and then is predryed in a hot air through dryer; this unpressed, pre-dryed, to at least 30% dry, but preferably 40% dry, web is then deposited onto the surface of a creping cylinder, is imprinted with the knuckle pattern of an imprinting fabric and then is creped off of the surface of the drying cylinder. Sanford, et al found that the resultant web when compared to a creped web made in accordance with a conventional papermaking process has increased softness, bulk and absorbency characteristics while at the same time having substantially the same tensile strength as the creped conventional web.

Although the Sanford, et al process is capable of making extremely soft, bulky and absorbent paper products when compared to paper products made using a conventional papermaking process, the use of a hot air through dryer is more complex, more expensive and less efficient than the Yankee Dryer used in a conventional papermaking machine.

Others in the prior art have considered it desirable to produce paper products having the softness, bulk and absorbency characteristics between those obtained from the conventional papermaking process and those obtained from the Sanford, et al process. It has been proposed in the prior art that the concept of differentially pressing the web in spots on a dryer as disclosed by Sanford, et al could be applied to the web being deposited onto the surface of the Yankee Dryer cylinder in a conventional papermaking machine. For example, U.S. Pat. No. 3,537,954 - Justus discloses several embodiments of paper machines in which a paper web is differentially pressed in spots while on the surface of a Yankee Dryer cylinder. FIG. 4 of Justus depicts a conventional papermaking machine configuration and is representative of the teaching of that patent. At column 4, lines 41–68, the papermaking machine of FIG. 4 is described as one in which the web is differentially pressed onto the surface of the drying cylinder by means of a special pick up felt. In describing the special pick up felt, Justus states that the design of the felt will be obvious to those skilled in the felt making art and that its weaving pattern may for example include hard twisted yarns or monofilament fillers running in a cross machine direction along the outer surface of the felt. These hard yarns or fillers should be spaced depending on the desired creping pattern. The hard yarns will cause higher localized pressure areas at the nip so that the creping pattern thus imparted to the web will follow the higher pressure areas to which the web has been previously subjected. The soft and resilient felt material located between the harder yarns will urge the web into intimate contact with the surface of the drying cylinder. That is the extent of the teaching of Justus concerning the type of felt to be used in his process.

Based on Justus' summary of his invention at column 1 lines 68–69 and at column 2 lines 12–13, 20–21 and 34–35, it appears that he is concerned with making sure that the entire surface of the imprinted web adjacent to the dryer makes intimate contact with the surface of the drying cylinder. The fact that the entire surface of the differentially pressed web makes intimate contact with the drying cylinder merely means that, for webs having the same basis weight, the dryer will remove as much water out of the differentially pressed web as it would out of the conventional overall pressed web. We believe that the greater problem was the fact that since the differentially pressed web is pressed in spots on the surface of the drying cylinder, less water was expelled or squeezed out of the web as compared to the conventional papermaking process in which the entire surface of the web is pressed. Two commercially unacceptable ways of removing this additional water is to have the sheet remain on the dryer for a longer period of time by slowing down the speed of the dryer or to increase the heat applied to the dryer while the dryer operates at the same dryer speed as in the equivalent conventional process.

It is an object of our invention to provide an improved conventional papermaking machine in which the dewatering felt is replaced with a dewatering and imprinting felt that differentially presses a paper web onto the surface of a drying cylinder. It is a further object of our invention that when our improved papermaking machine makes a paper web having substantially the same basis weight and tensile strength as paper made on a similarly configured conventional papermaking machine, and operates at substantially the same speed as the conventional papermaking machine, the resulting paper web will have increased bulk, softness and absorbency than the paper made on the conventional papermaking machine.

DISCLOSURE OF INVENTION

This is an improved papermaking machine of the type wherein a web of lignocellulosic fibers is formed on a wire and wherein the formed web is transferred from the wire to a dewatering and imprinting felt. When the formed web has a dryness level of between about 7% and about 35%, the felt and the web are passed through a nip formed by a pressure roll and a drying cylinder so as to deposit the web on the surface of the drying cylinder. The dewatering and imprinting felt includes yarn strands, preferrably extending in the cross machine direction, which form knuckles adjacent to the web contacting side of the felt. As the dewatering and imprinting felt and the paper web travel through the nip, the knuckles densify those portions of the web between the knuckles of the felt and the dryer surface to a greater degree than those portions of the web that are being pressed against the surface of the dryer by the felt facing material located between adjacent imprinting yarn strands. The center-to-center spacing of cross machine direction yarn strands that perform the imprinting of the web should be between about 1.0 mm to about 4.2 mm. The ratio of felt facing material in grams per square meter to the nominal diameter in meters of a cross machine direction imprinting yarn strand should be in a range of about 60,000 to 600,000. The cross machine direction imprinting yarn strands spacing should not be significantly greater than the average length of the fibers in the furnish.

In one preferred embodiment of the invention, the spacing of the cross machine direction imprinting yarn strands is about equal to the average length of the fibers in the furnish.

In another preferred embodiment, the felt facing material on the differential pressing felt is greater than about 153 grams per square meter.

In another preferred embodiment of the invention, the cross machine direction imprinting yarn strands have a nominal diameter greater than 0.762 mm.

BRIEF DESCRIPTION OF THE DRAWINGS

While the specification concludes with claims particularly pointing out and distinctly claiming that which is regarded as the present invention, the objects and advantages of this invention can be more readily ascertained from the following description of a preferred embodiment when read in conjunction with the accompanying drawings in which:

BEST MODE FOR CARRYING OUT THE INVENTION

Figure 1:
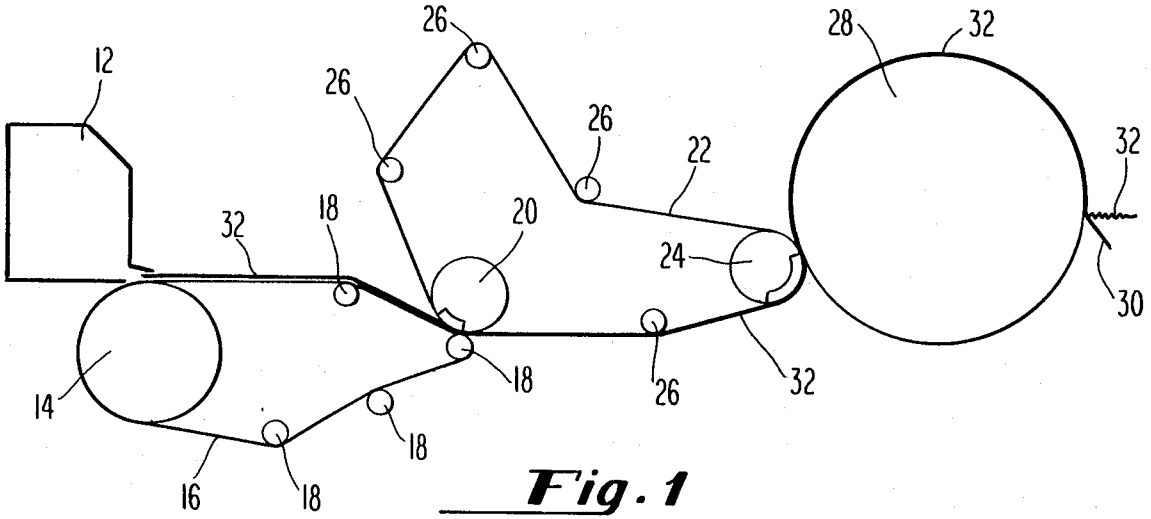
FIG. 1 is a schematic elevational view of an improved papermaking machine in accordance with the present invention.

Referring now to FIG. 1, there is shown one typical papermaking machine 10 configuration utilizing the improvements of this invention. A papermaking furnish of lignocellulosic, papermaking fibers is delivered from a head box 12 to a Fourdrinier wire 16 in the vicinity of a suction breast roll 14. The Fourdrinier wire 16 forms an endless loop as it passes around the suction breast roll 14 and wire return rolls 18. As the formed web 32 passes in the vicinity of a suction roll 20, the web 32 is transferred to a dewatering and imprinting felt 22. The dewatering and imprinting felt 22 travels in an endless loop formed by the suction roll 20, suction pressure roll 24 and wire return rolls 26. A pressure nip is formed between suction pressure roll 24 and a Yankee drying cylinder 28. As the dewatering and imprinting felt 22 and the web 32 travel through the nip formed by the suction pressure roll 24 and the drying cylinder 28, the web 32 is simultaneously deposited onto the surface of the drying cylinder 28 and is imprinted in spots by knuckles, formed by imprinting yarns in the felt 22, adjacent to the web contacting surface of the felt 22. As the imprinting felt 22 and the web 32 enter the nip formed by the pressure roll 24 and the drying cylinder 28, the web 32 is typically in the range of 12% to about 28% dry. It is believed that differential pressing of the web 32 by the felt 22 may be beneficial if the web 32 is as much as 35% dry and as little as about 7% dry. After the web is dryed on the drying cylinder 28, it is creped off of the drying cylinder 28 by means of a creping blade 30.

Figure 2:
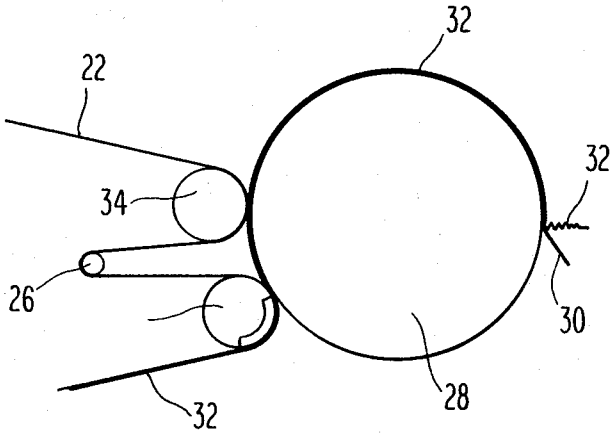
FIG. 2 is a fragmentary schematic elevational view of a modification of the machine shown in FIG. 1.

FIG. 2 is an alternate embodiment of an improved papermaking machine 10 in accordance with out invention. The configuration of FIG. 2 differs from the configuration of FIG. 1 in that after the dewatering and imprinting felt 22 passes through the nip formed by suction pressure roll 24 and the drying cylinder 28, it is removed from the web 32, then travels around turning roll 26 and around a second pressure roll 34 which is also located so as to provide a second pressure nip with the drying cylinder 28, thereby further differentially pressing the web 32 against the surface of drying cylinder 28.

It should be now mentioned that the paper machine 10 configuration of FIGS. 1 and 2 are substantially the same as that of a conventional overall wet pressed papermaking machine except for the special characteristics of the dewatering and imprinting felt 22 which will be described in detail below. It is the characteristic of the dewatering and imprinting felt 22 which enables the papermaking machine 10 of FIG. 1 to produce a web having the same basis weight and at the same machine speed as a machine using a conventional felt, yet the resulting paper has improved softness, bulk and absorbency characteristics over that of the sheet made with a conventional dewatering felt.

Figure 3:
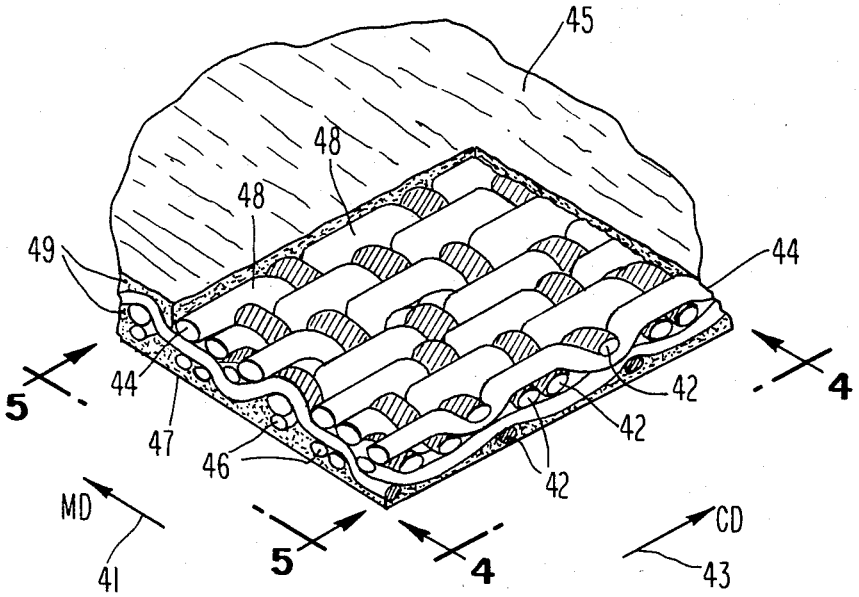
FIG. 3 is a perspective view, partially cut away, of a dewatering and imprinting felt used in the machine shown in FIG. 1.

FIG. 3 is a perspective view, partially cut away, of a portion of a typical dewatering and imprinting felt 22 used in the papermaking machine 10. The machine direction and the cross machine direction of the felt 22 are indicated by arrows 41 and 43 respectively. The top surface 45 is the sheet contacting surface of the felt 22 and the bottom surface 47 is the wire return rolls 26 contacting surface of the felt 22. One set of yarns 42 extends in the machine direction of the felt 22. Extending in the cross machine direction of the felt 22 is an upper set of imprinting yarns 44 and a second lower set of yarns 46. The upper set of imprinting yarns 44 is woven in the felt 22 so as to form knuckles 48 adjacent to the sheet bearing surface 45 of the felt 22. The felt facing material or batting 49 is that facing material that is applied from the sheet contacting side of the felt during manufacture and which extends above, through and slightly below the yarns 42, 44, 46 and assists in the dewatering of the web 32.

Figure 4:
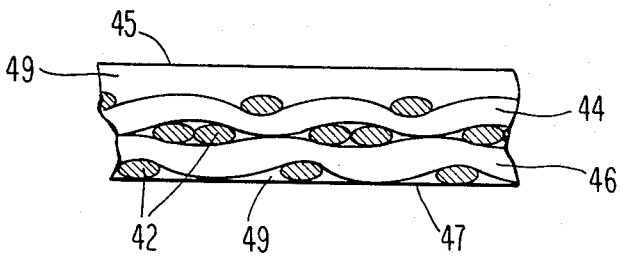
FIG. 4 is a section viewed along the line 4—4 of FIG. 3.
Figure 5:
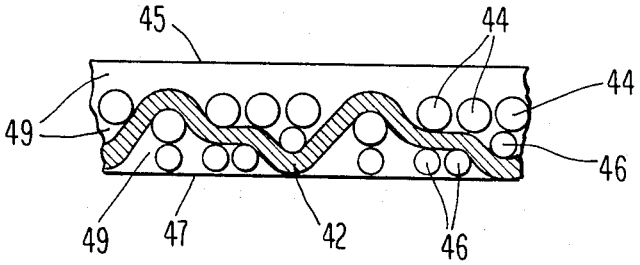
FIG. 5 is a section viewed along line 5—5 of FIG. 3.

As can best be seen in FIGS. 4 and 5, each imprinting yarn 44 has a repeat weave pattern which takes it under one machine direction yarn 42 and over three machine direction yarns 42. Each nonimprinting cross direction yarn 46 has a repeat weave pattern that takes it over one machine direction yarn and under three machine direction yarns 42. As can best be seen from FIG. 5 each machine direction yarn 42 has a repeat pattern that takes it over both an upper yarn 44 and a lower yarn 46, then between 2 upper yarns 44 and two lower yarns 46, and then beneath both an upper yarn 44 and a lower yarn 46.

TABLE I

| | Felt Number | | |
|---|---|---|---|
| | 1 | 2 | 3 |
| MD Strands/ 2.54 cm | 19 | 19 | 19 |
| CD Strands/ 2.54 cm | 40 | 40 | 40 |
| CD Yarn (sheet side) diameter (m)- type | 0.00091 9 ply mono | 0.00091 9 ply mono | 0.00091 9 ply mono |
| CD Yarn (back side) diameter - type | 0.00053 spun | 0.00053 spun | 0.00053 spun |
| Felt Facing Material ($g/m^2$) | 162 | 342 | 241 |
| Felt Weight ($g/m^2$) | 1098 | 1312 | 1129 |
| Felt Facing Material CD Yarn Diameter ($g/m^2/m$) | $1.78 \times 10^5$ | $3.76 \times 10^5$ | $2.65 \times 10^5$ |
| Strand spacing (mm) | 1.27 | 1.27 | 1.27 |
| Average fiber Length (mm) | | | |

TABLE II

| | Felt Number | | |
|---|---|---|---|
| | 4 | 5 | 6 |
| MD Strands/ 2.54 cm | 20 | 20 | 20 |
| CD Strands/ 2.54 cm | 40 | 32 | 32 |
| CD Yarn (sheet side) diameter (m)- type | 0.00091 9 ply mono | 0.0011 16 ply mono | 0.0011 16 ply mono |
| CD Yarn (back side) diameter - type | 0.00041 mono | 0.00041 mono | 0.00041 mono |
| Felt Facing Material ($g/m^2$) | 354 | 354 | 177 |
| Felt Weight ($g/m^2$) | 1177 | 1330 | 1092 |
| Felt Facing Material CD Yarn Diameter ($g/m^2/m$) | $3.89 \times 10^5$ | $3.22 \times 10^5$ | $1.61 \times 10^5$ |
| Strand Spacing (mm) | 1.27 | 1.58 | 1.58 |

TABLE II-continued

| | Felt Number | | |
|---|---|---|---|
| | 4 | 5 | 6 |
| Average Fiber length (mm) | 1.5-1.6 | 1.5-1.6 | 1.5-1.6 |

TABLE III

| | Felt Number | |
|---|---|---|
| | 7 | 8 |
| MD Strands/ 2.54 cm | 19 | 19 |
| CD Strands/ 2.54 cm | 44 | 37 |
| CD Yarn (sheet side) diameter (m)- type | 0.00041 mono | 0.00041 mono |
| CD Yarn (back side) diameter - type | 0.00053 spun | 0.00058 multifilament |
| Felt Facing Material ($g/m^2$) | 625 | 442 |
| Felt Weight ($g/m^2$) | 1196 | 1171 |
| Felt Facing Material CD Yarn Diameter ($g/m^2/m$) | $15.2 \times 10^5$ | $10.78 \times 10^5$ |
| Strand Spacing (mm) | 1.15 | 1.37 |

Tables I and II tabulate the characteristics of 6 dewatering and imprinting felts which have been used in testing our invention, while Table III tabulates those same characteristics for 2 typical felts used in a conventional papermaking process in which the web is uniformally pressed all over against the surface of the drying cylinder. All of the felts identified as 1 through 8 in Tables I, II, and III have two layers of cross direction yarns. The following information is tabulated for each felt:

(a) the number of yarn strands 42 in the machine direction per inch (2.54 cm);
(b) the number of cross direction strands 44, 46 per inch (2.54 cm);
(c) the diameter (meters) of the imprinting yarn 44 which forms knuckles 48 adjacent to the sheet contacting surface 45 of the felt and the yarn construction type;
(d) the diameter (meters) of the cross direction yarn 46 adjacent to the surface 47 of the felt that is not in contact with the web and the type of construction of the yarn;
(e) the amount of felt facing material 49 (grams per square meter);
(f) the felt weight (grams per square meter); and
(g) the ratio of the amount of felt facing material 49 to the diameter of the cross direction yarn adjacent to the sheet contacting surface 45 of the felt (grams per square meter per meter).

It should now be mentioned that it is common in the felt making art to specify a nominal diameter of a yarn strand even though the cross section of the yarn is not a perfect circle. Thus, while the specific felts discussed below have imprinting yarn strands 44 made by twisting either 9 or 16 smaller strands together, after the yarn is woven into a felt, it tends to flatten out and assume an oval cross section. We believe that the principles described herein apply to yarn strands having both circular and non-circular cross sections.

Referring now to Table I, dewatering and imprinting felt 1 was run on an experimental papermaking machine 10 operating at a drying cylinder 28 speed of 2.54 meters per second. Paper made by felts 1 and 2 were found to have some softness, bulk and absorbency improvements over a web having the same basis weight that was uniformly pressed all over on the surface of the drying cylinder while running at that same speed of 2.54 meters per second. Felt 3 of Table I was run on a commercial papermaking machine 10 operating at a drying cylinder 28 speed of about 10.16 meters per second. Paper made on that commercial machine also exhibited improved softness, bulk and absorbency characteristics when compared to paper having the same basis weight but which is uniformly pressed all over on the drying cylinder operating at a speed of 10.16 meters per second. Thus, felt 3 confirms that the improvements in softness, bulk and absorbency can be translated from the slower speed laboratory papermaking machine to the higher speed commercial papermaking machine.

Table II tabulates the characteristic of felt runs 4, 5 and 6 operating on an experimental laboratory machine 10 running at a drying cylinder 28 surface speed of about 3.56 meters per second. As will be further explained in connection with the description of FIGS. 9 and 10, paper made with differential pressing felt number 5 has an improved bulk and absorbency characteristic than that of a sheet made with a conventional over all pressing felt and paper made using felt number 6 exhibits even further improvements in bulk and absorbency that that of paper made with felt number 5.

Figure 6:
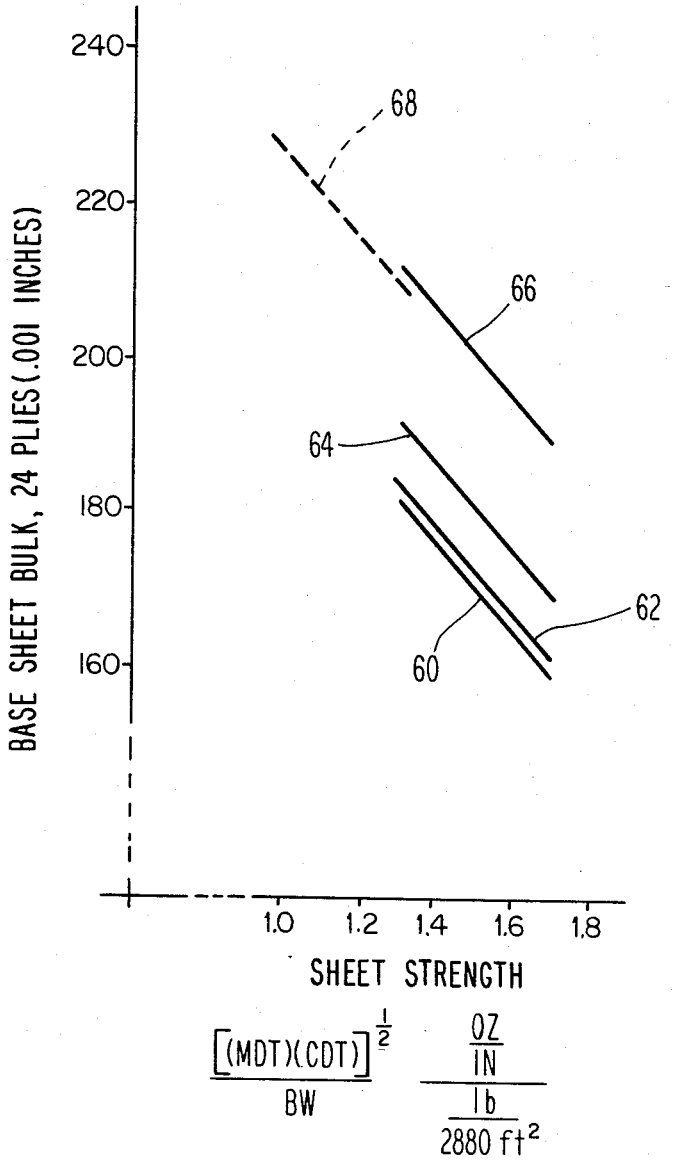
FIG. 6 is a graph of base sheet, after creping, bulk versus sheet strength of webs made in accordance with this invention.

FIG. 6 is a graph depicting base sheet bulk as a function of sheet strength for paper webs made on a laboratory experimental machine with a two pressure roll configuration running at about 3.56 meters per second. Bulk is here defined as the thickness, measured in thousandths of an inch, of 24 sheets when subjected to a load of 235 grams per square inch. Line 60 shows the bulk versus sheet strength relationship of webs made on a conventional uniform overall pressing felt of the type described as felt number 8 in Table III. Line 62 represents the bulk versus strength relationship of paper webs made on the same machine and at the same speed with the differential pressing felt number 4 in Table II and line 64 represents the actual bulk versus strength characteristic of paper webs made on that same machine operating at the same speed using the differential pressing felt identified number 5 in Table II. Based on the results with felts numbers 4 and 5, it was decided to run a further experiment on the machine utilizing felt number 6 in Table II. Based on the actual bulk versus sheet strength data obtained for felts 4 and 5, it was predicted that the bulk versus sheet strength characteristic for felt number 6 would be represented by the line 66 in FIG. 6. After the experiment with felt number 6 was run, the actual bulk measurement of the paper that was made was consistent with the predicted bulk versus sheet strength relationship as indicated by the predicted line 66. As can be seen from FIG. 6, felt number 5 produces a sheet having about 6% higher bulk than the sheet produced by the conventional felt number 8 and the differential pressing felt number 6 produces a sheet having about 15% higher bulk than the sheet manufactured by uniform pressing felt number 8.

Also shown in FIG. 6 is a dashed line 68 which shows the bulk versus sheet strength characteristic of paper webs made with a dewatering and imprinting fabric in which the imprinting yarns had a spacing of 3.17 mm. The average fiber length of that paper was about 1.5 to 1.6 mm. The resulting sheets had much lower strength than the sheets made with the conventional felt number 8 and the dewatering and imprinting felts 4, 5 and 6. This lack of tensile strength is attributed to the fact that the imprinting yarn spacing was substantially greater than the average fiber length. In contrast, from Table II, it can be seen that felts 4, 5 and 6 have an imprinting yarn spacing that is comparable to the average fiber length.

Figure 7:
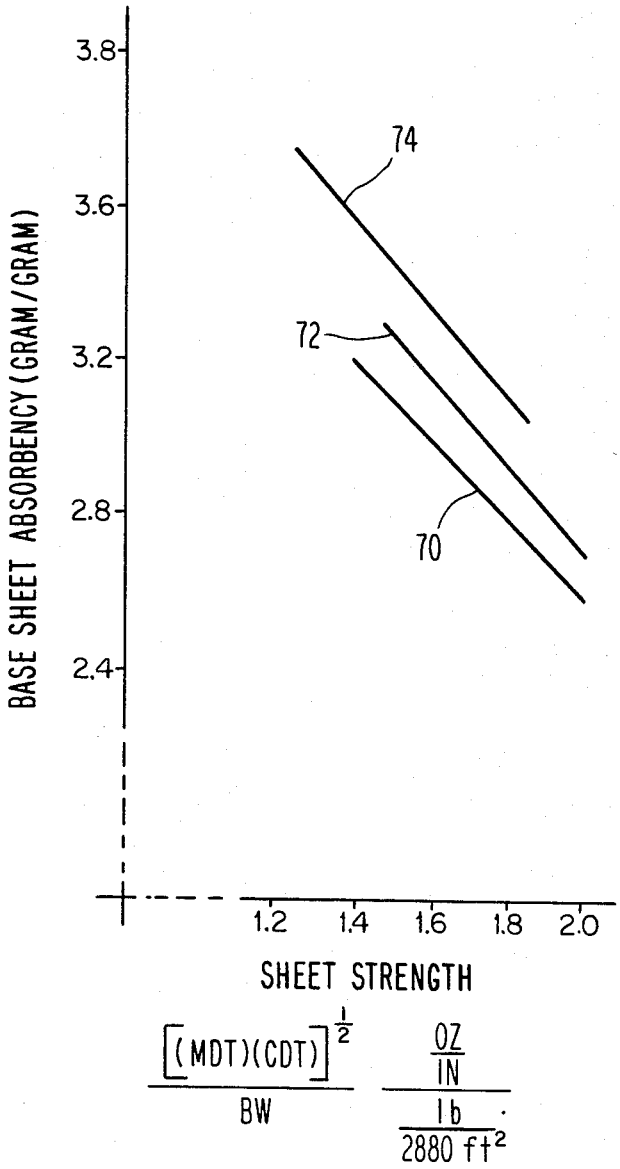
FIG. 7 is a graph depicting base sheet, after creping, absorbency versus sheet strength for webs made in accordance with this invention.

FIG. 7 shows the base sheet absorbency versus sheet strength for felts number 5, 6 and 8 used in a papermaking machine with a two pressure roll configuration. Line 70 shows the absorbency versus sheet strength characteristic for a paper web made on a conventional pressing felt, line 72 represents the absorbency versus sheet strength characteristic of paper webs made on felt number 5 and line 74 represents the absorbency versus sheet strength characteristic of webs made on felt number 6. From FIG. 7 it can be seen that paper made with felt number 5 has about a 5% increase in absorbency over a similar sheet made with a uniformly pressing felt and that paper made with felt number 6 has about 13% more absorbency than the paper made with a conventional uniform pressing felt.

Figure 8:
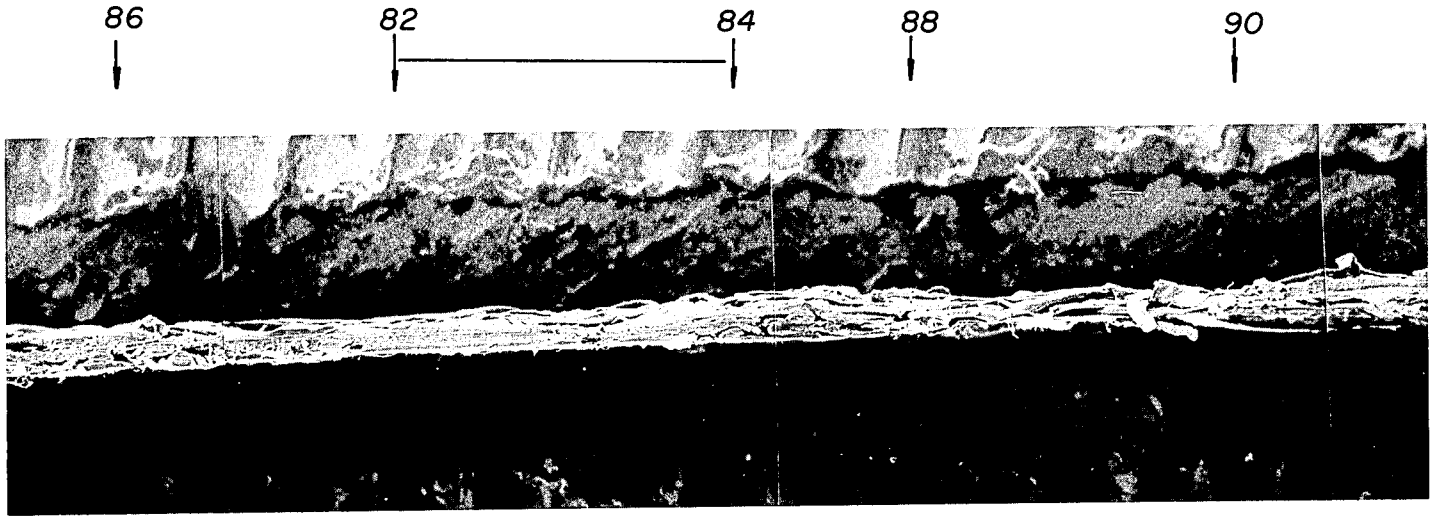
FIG. 8 is a photomicrograph showing the cross section of a paper web, prior to creping, made on a machine of the invention.

FIG. 8 is a photomicrograph (200 times magnification) of a cross section of a paper web made in accordance with this invention. That portion of the web 80 that lies beneath and between arrows 82 and 84 has been very densely compacted against the surface of the dryer by the knuckle 48 of a cross machine direction yarn 44 adjacent to the sheet contacting surface 45 of the differential pressing felt. In contrast, the portions of the web below arrows 86, 88 and 90 are less densely compacted than the portion of the web under arrows 82 and 84.

Figure 9:
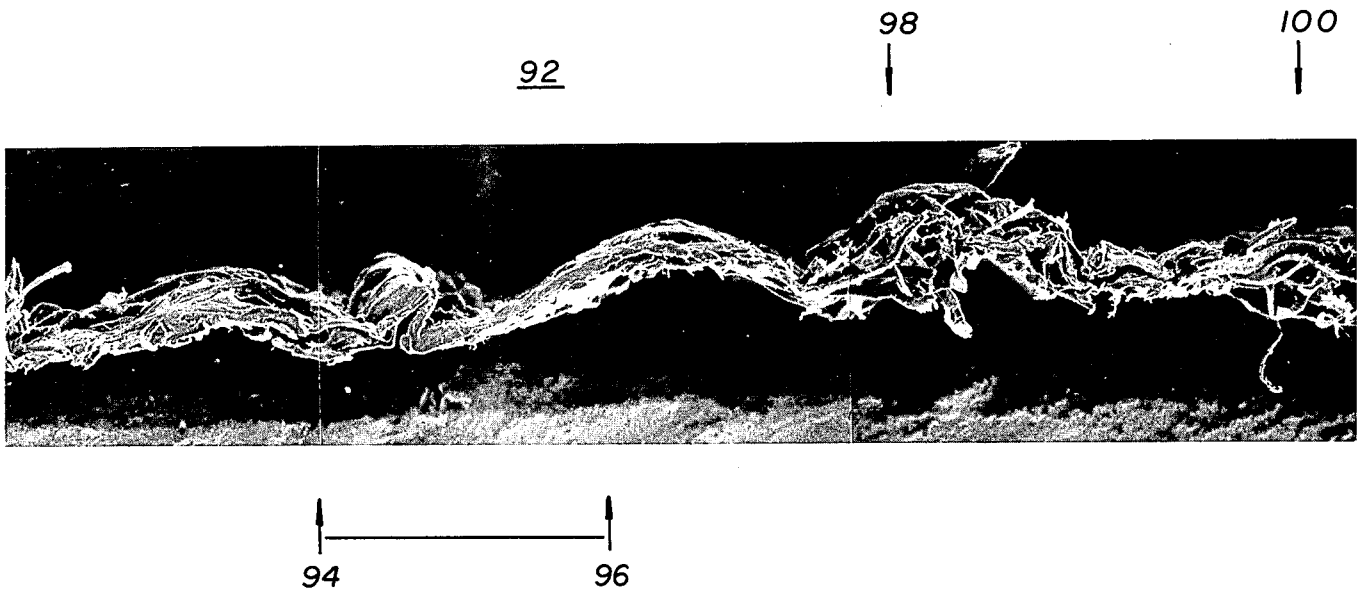
FIG. 9 is a photomicrograph showing the cross section of a base sheet, after creping that has been made on the improved machine of the invention.

FIG. 9 is a photomicrograph (200 times magnification) of a cross section of a web made with a differential pressing felt after the web has been creped. The portion of the web 92 above and between arrows 94 and 96 is a portion of the web that has been highly compacted against the surface of the dryer 28 by the knuckle 48 of a cross direction imprinting yarn 44. The portion of the web 92 depicted in FIG. 9 immediately below arrows 98 and 100 are the less dense portions of web 92 which have not been compacted by the knuckles 48 of the cross machine direction imprinting yarns 44.

As can be seen from FIG. 9, the creping step has a greater effect on increasing the bulk of the relatively less dense portions of the web under arrows 98 and 100 than it does on the higher density portion of the web between arrows 94 and 96.

Figure 10:
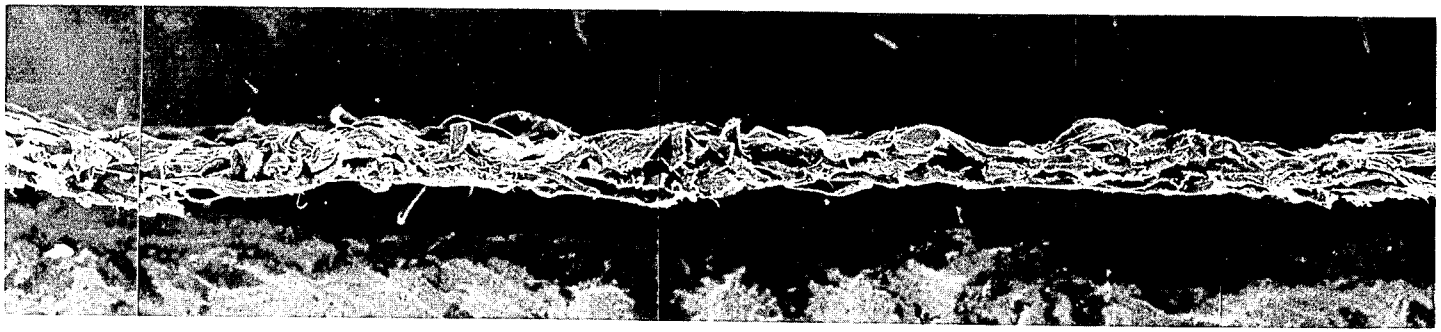
FIG. 10 is a photomicrograph showing the cross section of a prior art base sheet, after creping, made on a conventional wet pressed papermaking machine.

FIG. 10 is a photomicrograph (200 times magnification) of a cross section of a uniformly pressed sheet having the same basis weight as the differentially pressed sheet shown in FIGS. 8 and 9. The creped web 102 of FIG. 10 generally has a more uniform cross section than the differentially creped web 90 of FIG. 9. What is important from the softness, bulk and absorbency standpoint is the fact that the relatively less dense portions of the web 90 of FIG. 9 under arrows 98 and 100 are on the average thicker than the average thickness of the creped web which accounts for the increased softness bulk and absorbency characteristic of the differential pressed web.

From the data presented above, the following conclusions were drawn concerning the characteristics of a dewatering and imprinting felt capable of making a paper web having improved bulk and absorbency at the same speed and basis weight as a conventional machine. The spacing between adjacent imprinting yarns 44 which form imprinting knuckles 48 at the web contacting surface 45 of the felt should not be significantly greater than the average length of the fibers used in the furnish. Although felt runs 1–6 in Tables I and II have an imprinting yarn spacing of 1.27 to 1.58 mm, that is related to the fiber length of 1.5 to 1.6 mm, since the average length of papermaking fibers can range typically between 1.0 and 3.5 mm, the spacing of the imprinting yarns 44 can range between 25 to about 6 per 25.4 mm.

All of the differential press felts 1 through 6 have a ratio of web face to imprinting yarn nominal diameter of about 161,000 to about 389,000 which is significantly lower than that same ratio for typical overall pressing felts which, as can be seen from Table III, have ratios in excess of 1,080,000.

The nominal diameter of the imprinting yarns 44 for felts 1–6 of Table I and II are also relatively large, that is greater than 0.762 mm, when compared to the diameter of the yarns used in the conventional overall pressing felts.

Since the differential pressing felts 1–6 have a smaller ratio of felt facing material to nominal diameter of imprinting yarn than the conventional overall pressing felt yet uses a larger nominal diameter of yarn than the conventional felt, the differential pressing felt has less felt facing material than the conventional felt. This is surprising since the differentially pressing web must remove the same amount of water from the web as does the conventional uniform overall pressing felt. Table II shows that as little as 162 $g/m^2$ of felt facing material can be used in a differentially wet pressing felt, and it is believed that the felt facing material can not be significantly lower than that in order to adequately dewater the paper web.

We have found that for the specific machine configuration and papermaking furnish that was employed that differential pressing felts having imprinting yarn nominal diameters of less than 7.1 mm were able to make paper webs having increased bulk and absorbency, however, the machine could not make the paper webs at the same speed as with a conventional papermaking felt. It is believed that smaller diameter imprinting yarns might be used without any speed penalty on certain other machine configurations or with other papermaking furnishes.

What is claimed as new and desired to be secured by letters patent of the United States is:

1. In a papermaking machine of the type wherein a web of lingnocellulosic fibers is formed, and wherein the formed web is transferred to a dewatering and imprinting felt, said felt and web then passing through a nip formed by a pressure roll and a drying cylinder so as to deposit the web on the drying cylinder, said web having a dryness level between 7 percent and 35 percent as it enters said nip, wherein the felt in the papermaking machine is characterized by having imprinting yarn strands forming knuckles adjacent to the web contacting surface of the felt, the imprinting yarn strands having a spacing of about 6 to about 25 per 0.0254 meters but not significantly exceeding the average fiber length, the felt having a felt facing material greater than about 153 grams per square meter, and the felt having a ratio of felt facing material in grams per square meter to the diameter in meters of the imprinting yarn strands of from about 60,000 to about 600,000 whereby the web is differentially pressed onto the dryer surface.

2. A papermaking machine as recited in claim 1 wherein the imprinting yarn strands of the felt extend in the cross direction of the papermaking machine.

3. A papermaking machine as recited in claim 1 further comprising a second pressure roll, the felt after depositing the web on the dryer passing around the second pressure roll, the second pressure roll and felt being located in nip relationship to the web on the dryer whereby the web is further differentially pressed on the dryer surface.

4. A papermaking machine as recited in claim 1 further comprising means for creping the web off of the surface of the dryer.

5. A papermaking machine as recited in claim 1 wherein the imprinting yarn spacing is about equal to the average fiber length.

6. An improved papermaking machine as recited in claim 1 wherein the dryness level is between about 12 and 28 percent dry.

7. An improved papermaking machine as recited in claim 1 wherein the cross machine direction yarn strands of the felt have a nominal diameter greater than 0.000762 meters.

8. An improved papermaking machine as recited in claim 2 wherein the felt includes additional cross machine direction yarn strands adjacent the surface of the felt not in contact with the web.

9. An improved papermaking machine as recited in claim 1 wherein the ratio of felt facing material to nominal diameter is about 120,000 to about 420,000.

10. An improved papermaking machine as recited in claim 2 wherein the imprinting yarn spacing of the felt is about equal to the average fiber length.

11. An improved papermaking machine as recited in claim 2 wherein the cross machine direction yarn strands of the felt have a nominal diameter greater than 0.000762 meters.

12. An improved papermaking machine as recited in claim 2 wherein the dryness level is between about 12 and 28 percent dry.

13. An improved papermaking machine as recited in claim 2 wherein the ratio of felt facing material to nominal diameter is about 120,000 to about 420,000.

14. An improved papermaking machine as recited in claim 12 wherein the cross machine direction yarn strands of the felt have a nominal diameter greater than 0.000762 meters.

15. An improved papermaking machine as recited in claim 12 wherein the ratio of felt facing material to nominal diameter is about 120,000 to about 420,000.

16. An improved papermaking machine as recited in claim 15 wherein the cross machine direction yarn strands of the felt have a nominal diameter greater than 0.000762 meters.

17. An improved papermaking machine as recited in claim 14 wherein the imprinting yarn spacing of the felt is about equal to the average fiber length.

18. A papermaking machine as recited in claim 16 wherein the imprinting yarn spacing of the felt is about equal to the average fiber length.

19. A papermaking machine as recited in claim 18 wherein the felt includes additional cross machine direction yarn strands adjacent the surface of the felt not in contact with the web.

20. A papermaking machine as recited in claim 18 further comprising a second pressure roll, the felt after depositing the web on the dryer passing around the second pressure roll, the second pressure roll and felt being located in nip relationship to the web on the dryer whereby the web is further differentially pressed on the dryer surface.

21. A papermaking machine as recited in claim 18 further comprising means for creping the web off of the surface of the dryer.

22. A papermaking machine as recited in claim 1 wherein the felt facing material is between 153 to 400 grams per square meter.

23. A papermaking machine as recited in claim 2 wherein the felt facing material is between 153 to 400 grams per square meter.

24. A papermaking machine as recited in claim 12 wherein the felt facing material is between 153 to 400 grams per square meter.

25. A papermaking machine as recited in claim 14 wherein the felt facing material is between 153 to 400 grams per square meter.

26. A papermaking machine as recited in claim 15 wherein the felt facing material is between 153 to 400 grams per square meter.

27. A papermaking machine as recited in claim 16 wherein the felt facing material is between 153 to 400 grams per square meter.

28. A papermaking machine as recited in claim 17 wherein the felt facing material is between 153 to 400 grams per square meter.

29. A papermaking machine as recited in claim 19 wherein the felt facing material is between 153 to 400 grams per square meter.

30. A papermaking machine as recited in claim 20 wherein the felt facing material is between 153 to 400 grams per square meter.

* * * * *